US007849833B2

(12) United States Patent
Toyoda

(10) Patent No.: US 7,849,833 B2
(45) Date of Patent: Dec. 14, 2010

(54) ENGINE HEAD STRUCTURE

(75) Inventor: Inao Toyoda, Anjo (JP)

(73) Assignee: DENSO CORPORATION, Kariya (JP)

( * ) Notice: Subject to any disclaimer, the term of this patent is extended or adjusted under 35 U.S.C. 154(b) by 50 days.

(21) Appl. No.: 12/320,546

(22) Filed: Jan. 29, 2009

(65) Prior Publication Data

US 2009/0217913 A1 Sep. 3, 2009

(30) Foreign Application Priority Data

Feb. 28, 2008 (JP) ..... 2008-047726

(51) Int. Cl.
*F02M 57/06* (2006.01)
*F02M 61/14* (2006.01)

(52) U.S. Cl. ..... 123/297; 123/470

(58) Field of Classification Search ..... 123/297, 123/470, 193.2; 73/35.12, 35.13, 114.19
See application file for complete search history.

(56) References Cited

U.S. PATENT DOCUMENTS 4,006,725 A * 2/1977 Baczek et al. ..... 123/267
4,169,388 A * 10/1979 Teitelbaum et al. ..... 73/114.21
4,969,353 A * 11/1990 Steinke ..... 73/114.19
5,101,659 A * 4/1992 Takeuchi ..... 73/114.19
5,609,130 A * 3/1997 Neumann ..... 123/267
6,055,955 A 5/2000 Benedikt et al.
6,597,088 B1 * 7/2003 Glaser et al. ..... 73/114.19
6,871,630 B2 * 3/2005 Herden et al. ..... 123/297
6,925,983 B2 * 8/2005 Herden et al. ..... 123/297
6,952,948 B2 * 10/2005 Herbert et al. ..... 73/35.12
6,955,154 B1 * 10/2005 Douglas ..... 123/297
7,171,846 B2 * 2/2007 Sakamoto et al. ..... 73/114.18
2001/0008090 A1 * 7/2001 Murai et al. ..... 73/756
2001/0015402 A1 * 8/2001 Murai et al. ..... 248/554
2004/0084011 A1 5/2004 Herden et al.
2004/0112328 A1 * 6/2004 Herden et al. ..... 123/297
2006/0123887 A1 6/2006 Dordet
2006/0156825 A1 7/2006 Toyoda et al.
2008/0072871 A1 3/2008 Vogel et al.

FOREIGN PATENT DOCUMENTS

JP A-50-143581 11/1975
JP A-57-000361 1/1982
JP A-07-318448 12/1995
JP A-2008-70212 3/2008

OTHER PUBLICATIONS

Notice of Reason for Refusal issued from the Japanese Patent Office on Dec. 22, 2009 in the corresponding Japanese patent application No. 2008-047726 (with English translation).

* cited by examiner

*Primary Examiner*—Stephen K Cronin
*Assistant Examiner*—Arnold Castro
(74) *Attorney, Agent, or Firm*—Posz Law Group, PLC

(57) ABSTRACT

An injector, a spark plug and a pressure sensor are assembled integrally in a common housing. The common housing is fixed in a mounting hole provided in a cylinder head of an engine so that tip end portions of the injector, the spark plug and the pressure sensor face inside of the cylinder room. For example, a gasket having heat resistance can be provided between a lower end portion of an outer wall of the common housing and an inner wall of the mounting hole for the air-tight sealing. Furthermore, a concave portion may be provided at an outer portion of the common housing so as to form a coolant passage.

6 Claims, 2 Drawing Sheets

ENGINE HEAD STRUCTURE

CROSS REFERENCE TO RELATED APPLICATION

The present application is based on Japanese Patent Application No. 2008-047726 filed on Feb. 28, 2008, the disclosure of which is incorporated herein by reference.

FIELD OF THE INVENTION

The present invention relates to an engine head structure with an engine head module for a cylinder head of an engine.

BACKGROUND OF THE INVENTION

A fuel direct-injection engine, e.g., a gasoline engine, of vehicles is disclosed in U.S. Pat. No. 6,055,955 corresponding to JP-A-2000-501816. The fuel direct-injection engine is configured such that a fuel injector and a spark plug are attached to a cylinder head of the engine.

In an electric control system of this kind of vehicle engine, a fuel injection control and a spark timing control are performed by an ECU based on detection signals of multiple sensors for detecting states of the engine so that the engine is driven in an optimum condition. Recently, it is considered that failure in combustion and ignition is detected by a pressure sensor for detecting pressure inside a cylinder room of the engine. As an example of the pressure sensor, US Patent Publication No. 2006156825 corresponding to JP-A-2006-200974 discloses the structure that a pipe portion is formed integrally in a housing, and a diaphragm for receiving pressure inside a cylinder room directly and a pressure detecting element to which the pressure is transmitted are disposed at an end portion of the pipe portion.

In case that the above-described pressure sensor is attached to the engine, a mounting hole is formed at a cylinder head or a cylinder block, the pressure sensor is inserted into the mounting hole from the outside, and the pressure sensor is fixed to the cylinder head by welding or the like. Because an inlet valve, an outlet valve, an injector and a spark plug or the like are disposed in the cylinder head, it is difficult for the pressure sensor to be further disposed in the cylinder head due to space limitations. That is, the pressure sensor is required to be assembled compactly when the pressure sensor is attached to the engine.

Pressure inside the cylinder room becomes about 10 MPa by combustion pressure, and thereby, the air-tight sealing structure is required between the mounting hole and the pressure sensor. Thus, the mounting structure of the pressure sensor may become complex. Because the pressure sensor is weak against heat generally, the pressure sensor is required to be attached to the engine such that the pressure sensor does not become high temperature and detection reliability is increased. In addition, by welding a small element such as the pressure sensor to a large element such as the cylinder head, a large welding apparatus may be required, the workability of assembling may be decreased, and the manufacturing cost may be increased.

SUMMARY OF THE INVENTION

It is an object of the present invention to provide an engine head structure, in which a pressure sensor for detecting pressure inside a cylinder room of an engine can be disposed easily and its assembling structure can be simplified.

According to an aspect of the present disclosure, an engine head structure for an engine having a cylinder room includes an engine head module and a cylinder head. The engine head module includes a common housing having therein an injector, a spark plug, and a pressure sensor which are integrally assembled therein. The cylinder head has a mounting hole in which the common housing is fixed. The pressure sensor is located to detect a pressure inside the cylinder room. Tip end portions of the injector, the spark plug and the pressure sensor integrated in the common housing are configured to face inside of the cylinder room.

In the above configuration, because the pressure sensor for detecting pressure inside the cylinder room of the engine is disposed integrally in the common housing together with the injector and the spark plug, the pressure sensor can be attached easily to the cylinder head without being directly bonded to the cylinder head. Thus, the pressure sensor can be disposed easily while the assembling structure of the engine head module can be simplified.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

Figure 1:
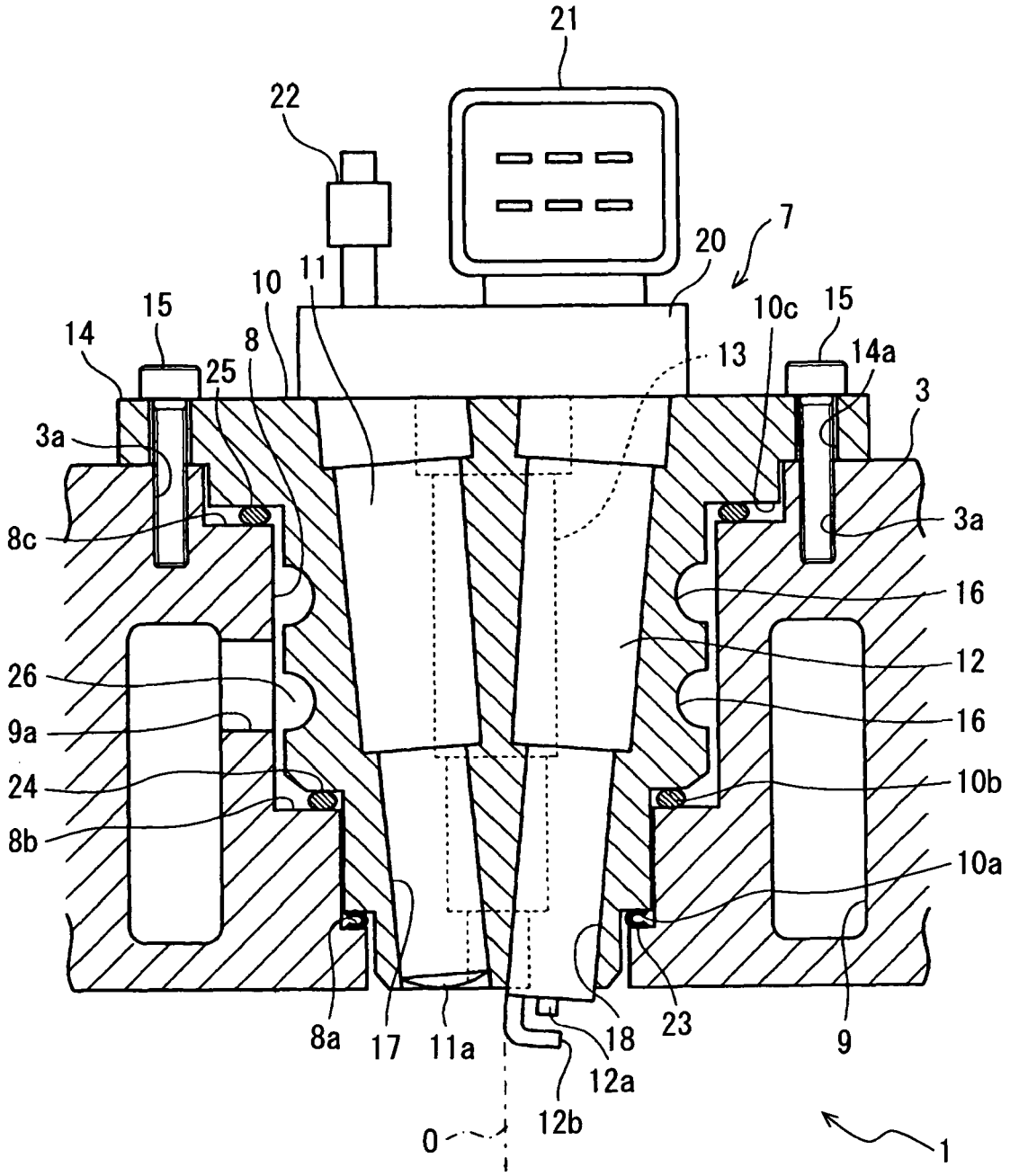
FIG. 1 is a longitudinal cross-sectional view showing a configuration and an assembling structure of an engine head module into a cylinder head according to an embodiment of the present invention.

Hereinafter, an embodiment of the present invention will be described with reference to FIG. 1 to FIG. 3. FIG. 3 shows an engine head module 7 located at an upper portion of one cylinder room 1 of a vehicle engine, for example. The cylinder room 1 is configured by a cylinder block 2 and a cylinder head 3. Inside the cylinder room 1, a piston 4 is arranged to be movable upwardly or downwardly. A valve 5 for opening and closing an inlet, and a valve 6 for opening and closing an outlet are arranged at both sides of an upper part of the cylinder room 1. An engine head module 7, which is hereinafter referred to a module 7, according to the present embodiment is arranged between the inlet and the outlet. A plurality of the modules 7 are mounted respectively to the cylinders of the engine.

FIG. 1 shows a configuration and an assembling structure of the module 7 according to the present embodiment. A mounting hole 8, in which the module 7 is fixed, is formed at a center portion of the cylinder head 3 to penetrate through the cylinder head 3 in an up-down direction. The mounting hole 8 has approximately a circular shape on the whole. The mounting hole 8 is configured with a cylindrical lower surface portion adjacent to a bottom side of the cylinder head 3, a cylindrical first surface portion adjacent to the lower surface portion via a first step portion 8*a* at an upper side of the lower surface portion, a cylindrical second surface portion adjacent to the first surface portion via a second step portion 8*b* at an upper side of the first surface portion, a cylindrical third surface portion adjacent to the second surface portion via a third step portion 8*c* at an upper side of the second surface portion. The first, second and third step portions 8*a*, 8*b*, 8*c* are provided such that the diameter of the lower surface portion is smallest, the diameter of the first surface portion is larger than the lower surface portion, the diameter of the second surface portion is larger than the first surface portion, and the diameter of the third surface portion is larger than the second surface portion. A water passage 9, to which an engine coolant is supplied, adjacent to the mounting hole 8 is arranged at an outer peripheral portion of the mounting hole 8 in the cylinder head 3.

The module 7 is configured by integrally assembling an injector 11, a spark plug 12 and a pressure sensor 13 in a common housing 10. The pressure sensor 13 is located to detect internal pressure of the cylinder room 1. The module 7 is fitted in the mounting hole 8 to be attached to the cylinder head 3. The common housing 10 is made of metal such as SUS or aluminum, and has a columnar block shape as a whole. The common housing 10 is configured such that a diameter thereof decreases stepwise from a top portion to a bottom portion in FIG. 1, i.e., toward the cylinder room 1 so as to fit to the mounting hole 8 from above.

Specifically, the common housing 10 is configured with a cylindrical lower portion corresponding to the lower surface portion of the mounting hole 8, a cylindrical first portion adjacent to the lower portion via a first step portion 10*a* at an upper side of the bottom portion, a cylindrical second portion adjacent to the first portion via a second step portion 10*b* at an upper side of the first portion, a cylindrical third portion adjacent to the second portion via a third step portion 10*c* at an upper side of the second portion. The first, second and third step portions 10*a*, 10*b*, 10*c* are provided such that the diameter of the lower portion is smallest, the diameter of the first portion is larger than the lower portion, the diameter of the second portion is larger than the first portion, and the diameter of the third portion is larger than the second portion. An upper portion of the common housing 10 is configured to have a flange portion, and the diameter of the flange portion of the common housing 10 is larger than the largest inner diameter of the mounting hole 8.

The flange portion of the common housing 10 is disposed on the top surface of the cylinder head 3 so as to cover the mounting hole 8, and is also used as a connecting portion 14 with the cylinder head 3 by using bolts at a plurality of positions. A plurality of screw holes 3*a* are formed in the cylinder head 3 to be open from the top surface. For example, four screw holes 3*a* are formed at intervals of 90 degrees. As shown in FIG. 2, holes 14*a* for inserting bolts are also formed in the connecting portion 14 of the common housing 10. As shown in FIG. 1, bolts 15 are respectively inserted into the screw holes 3*a* via the holes 14*a*.

A concave portion 16 is formed at a middle portion between the second step portion 10*b* and the third step portion 10*c*, of an outer surface of the common housing 10 so that a gap is formed between the middle portion of the outer surface of the common housing 10 and a middle portion between the second step portion 8*b* and the third step portion 8*c*, of an inner wall of the mounting hole 8. The concave portion 16 extends circumferentially in an entire circumference. The concave portion 16 is a groove having a circular shape, e.g., a semicircular shape, in cross section. In the present embodiment, two concave portions 16 are formed to be aligned in the up-down direction. Accordingly, a coolant passage 26 is formed between the outer surface of the common housing 10 and the inner wall of the mounting hole 8 by using the concave portion 16, as described below.

Figure 2:
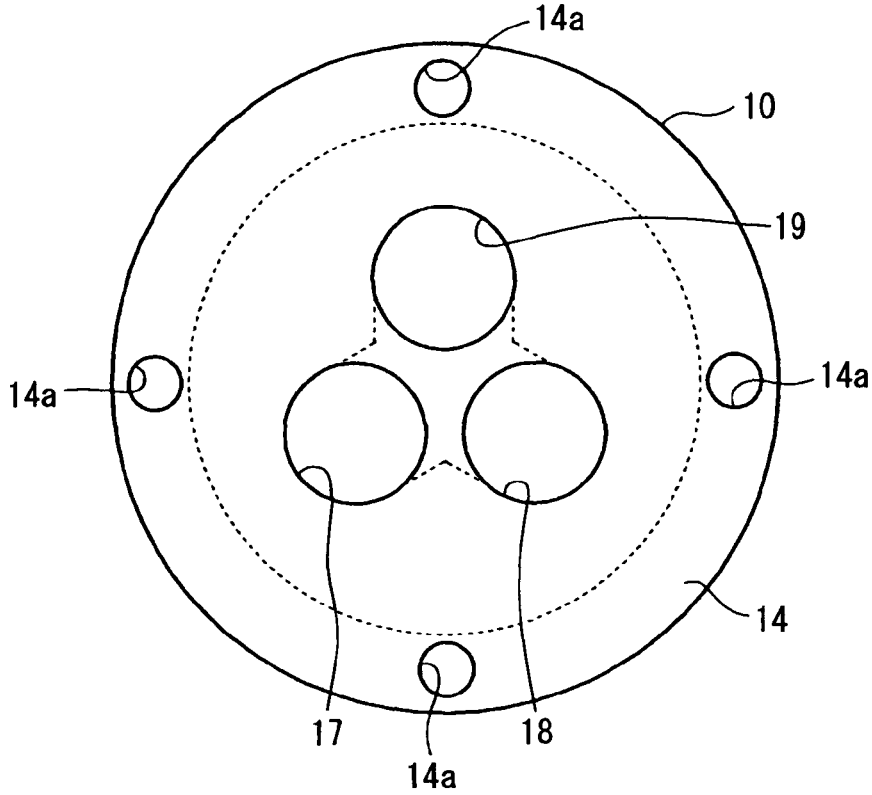
FIG. 2 is a plan view showing a common housing.
Figure 3:
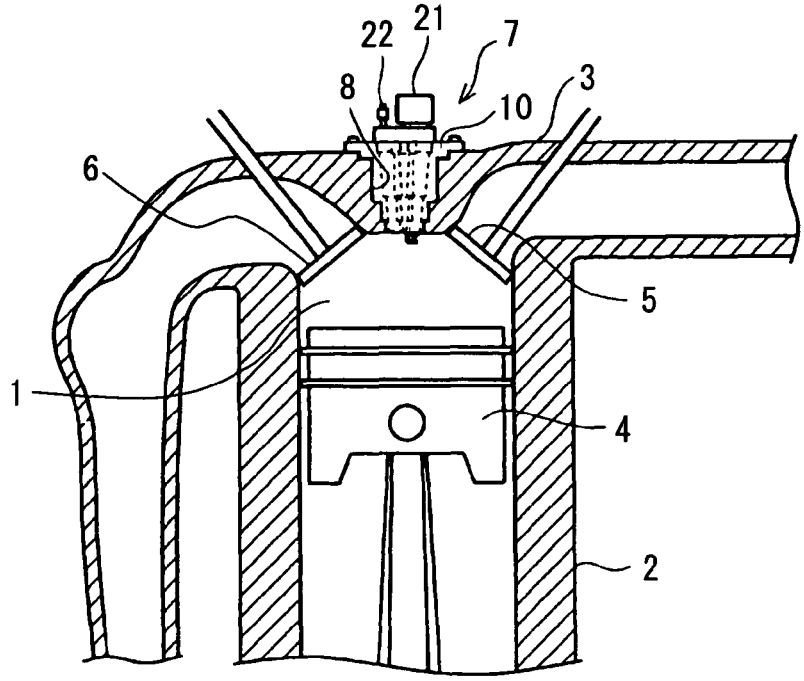
FIG. 3 is a longitudinal cross-sectional view showing a configuration of an engine head module mounted in a cylinder of an engine.

As shown in FIG. 2, a first opening 17, a second opening 18 and a third opening 19 are formed in the common housing 10. The openings 17, 18, 19 are formed to open at both the top end portion and the bottom end portion of the common housing 10, that is, the openings 17, 18, 19 penetrate through the common housing 10 in the up-down direction. Opening portions at the top end portion are slightly separated from the center of the top surface of the common housing 10 toward the circumference, and located circumferentially at regular intervals, e.g., at intervals of 120 degrees. The opening 17, 18, 19 are configured to be tilted relative to a line parallel to a center line O in the up-down direction to be closer to the center of the common housing 10 as toward the bottom end portion of the common housing 10. The injector 11, the spark plug 12 and the pressure sensor 13 are inserted and fixed to the openings 17, 18, 19, respectively. In accordance with shapes of the injector 11, the spark plug 12 and the pressure sensor 13, the openings 17, 18, 19 are configured such that diameters of the lower portions thereof become smaller.

The injector 11 has a generally known structure, and thus, is not shown in the drawing in detail. The injector 11 includes a nozzle 11*a* at a tip end portion of a vertically long housing, and a needle valve and a solenoid for driving the valve are included in the housing. The injector 11 is inserted into the first opening 17 from above and fixed to the first opening 17 by welding, caulking and screwing or the like. The nozzle 11*a* is arranged approximately on the same plane with the bottom surface of the common housing 10.

The spark plug 12 has a generally known structure, and thus, is not shown in the drawing in detail. A center electrode 12*a* and a ground electrode 12*b*, which are opposite to each other with a spark gap therebetween, are arranged at a lower end portion of an insulator made of ceramic. An outer surface at an end side of the insulator is covered by a shell made of metal. The spark plug 12 is inserted into the second opening 18 from above and fixed to the second opening 18 by welding, caulking and screwing or the like. The center electrode 12*a* and the ground electrode 12*b* protrude downwardly from the bottom surface of the common housing 10.

The pressure sensor 13 is configured as follows. A pipe portion is provided integrally in a housing made of metal such as SUS, a diaphragm made of metal for receiving pressure inside the cylinder room 1 and a pressure-sensitive element to which the pressure is transmitted are provided at an end of the pipe portion, and a signal processing circuit is provided in the housing. The pressure sensor 13 is inserted into the third opening 19 from above and fixed to the third opening 19 by welding, caulking and screwing or the like. The end of the pipe portion is arranged approximately on the same plane with the bottom surface of the common housing 10.

A single cover portion 20 for entirely covering upper end portions of the injector 11, the spark plug 12 and the pressure sensor 13 is arranged on the top surface portion of the common housing 10 by welding, for example. A common connector 21 for electrically connecting the injector 11, the pressure sensor 13 and an ECU, which is not shown in the drawings, and a fuel connector 22 for supplying fuel to the injector 11 are arranged on an upper surface of the cover portion 20. A high pressure connector, which is not shown in the drawings, for applying voltage to the spark plug 12 is arranged separately from the common connector 21.

The module 7 configured as described above is inserted into the mounting hole 8 of the cylinder head 3 from above, and the module 7 is attached to the cylinder head 3 by bolting at the connecting portion 14. In the present embodiment, as shown in FIG. 1, a gasket 23 having heat resistance, which is configured by a metal C-ring, is disposed for air-tight sealing, i.e., pressure shutoff, between the lower end portion of the outer wall of the common housing 10 and the inner wall of the mounting hole 8, that is, between the first step portion 10*a* and the first step portion 8*a*. As the gasket 23, a metal touch seal, i.e., a seal with metal touch, may be used. Furthermore, the gasket 23 may be made of a foam carbon.

Rubber O-rings 24 and 25 are disposed above and under the concave portion 16 to be positioned between the outer wall of the common housing 10 and the inner wall of the mounting hole 8, for example. That is, the O-ring 24 is disposed between the second step portion 10*b* and the second step portion 8*b*, and the O-ring 25 is disposed between the third step portion 10*c* and the third step portion 8*c*, respectively. Thereby, a gap formed by the concave portion 16 is sealed at both an upper portion and a lower portion of the concave portion 16. Further, a part of the water passage 9 formed in the cylinder head 3 is connected to the gap via a path 9*a*. Thereby, the coolant passage 26 is configured at an outer portion of the common housing 10 so that the engine coolant is supplied to the coolant passage 26 via the path 9*a*.

In such the assembling state of the module 7, the bottom surface of the common housing 10 and tip end portions of the injector 11 and the pressure sensor 13 are arranged on the same plane. The bottom surface of the common housing 10 and the tip end portions of the injector 11 and the pressure sensor 13 configure a plane with a bottom surface of the cylinder head 3, i.e., a surface toward the cylinder room 1, smoothly without irregularities. Only a tip end portion of the spark plug 12, i.e., a spark generating portion, of the spark plug 12 protrudes into the cylinder room 1.

In addition, the nozzle 11*a* located at the tip end portion of the injector 11 is open toward the center inside the cylinder room 1, i.e., the center line O so that fuel is sprayed from the injector 11 toward the center inside the cylinder room 1. Further, the diaphragm for receiving pressure is arranged at the end portion of the pressure sensor 13 to face inside of the cylinder room 1, and to detect pressure inside the cylinder room 1. The pressure sensor 13 can be arranged in the cylinder room 1 adjacent to the inlet in which the valve 5 is located, at which temperature is lower than at the outlet in which the valve 6 is located.

Next, function and effect by the above-described configuration will be described. In the module 7 of the first embodiment, the injector 11, the spark plug 12 and the pressure sensor 13 are assembled integrally to the single common housing 10, and then, the integrated common housing 10 is attached to the cylinder head 3. Therefore, the pressure sensor 13 can be arranged in the cylinder head 3 compactly with a single structure.

Compared to the case that the injector 11, the spark plug 12 and the pressure sensor 13 are assembled individually, the assembling space can be reduced. Further, the assembling structure becomes simple by sharing the sealing portion. The common housing 10 can be attached to the cylinder head 3 easily by bolting at the connecting portion 14. The pressure sensor 13 is attached to the common housing 10 by welding, for example, and thereby, a large element such as the cylinder head 3 does not need to be welded directly. Therefore, the welding apparatus need not become large, and the high workability of assembling can be obtained.

In the module 7 of the present embodiment, the injector 11, the spark plug 12 and the pressure sensor 13 are assembled to be tilted relative to a line parallel to the center line O in the up-down direction so as to face the center of the cylinder room 1, respectively. Thereby, fuel can be sprayed from the nozzle 11*a* of the injector 11 toward the center inside the cylinder room 1. Further, the whole outer shape of the common housing 10 is tapered toward the inside of the cylinder room 1, and thereby, the portion of the housing 10 facing the cylinder room 1 can be reduced.

In the present embodiment, the coolant passage 26 to which the engine coolant is supplied is formed at the outer surface of the common housing 10, and the common housing 10 and the pressure sensor 13 can be cooled efficiently by the engine coolant. Coupled with the arrangement of the pressure sensor 13 at the inlet side adjacent to the valve 5, stability and reliability of detecting pressure inside the cylinder room 1 by the pressure sensor 13 can be increased. The coolant passage 26 can be formed simply by forming the concave portion 16 at the common housing 10 and disposing the two O-rings 24 and 25.

The gasket 23 having heat resistance is disposed between the lower end portion of the outer wall of the common housing 10 and the inner wall of the mounting hole 8, the two O-rings 24 and 25 are disposed, and the opening at the top portion of the mounting hole 8 is closed by the connecting portion 14. Thereby, the sealing structure having high airtightness can be configured. The common connector 21 for electrically connecting the injector 11, the pressure sensor 13 and an external device such as the ECU is arranged at the cover portion 20 of the common housing 10. Thereby, the structure for the electrical connecting can be simplified.

In the present embodiment, the bottom surface of the common housing 10 and the tip end portions of the injector 11 and the pressure sensor 13 are formed to configure the same plane with the bottom surface of the cylinder head 3 smoothly without irregularities. Thus, irregularities on the inner wall of the cylinder room 1 can be reduced, and defects such as occurrence of anomalous combustion or carbon adhesion can be prevented.

According to the present embodiment, the injector 11, the spark plug 12 and the pressure sensor 13 are assembled integrally in the common housing 10, and the integrated common housing 10 is attached to the cylinder head 3 so as to form the module 7. Therefore, the pressure sensor 13 for detecting pressure inside the cylinder room 1 of the engine can be arranged compactly and the assembling structure can be simplified.

In the present embodiment, the common connector 21 for electrically connecting the injector 11, the pressure sensor 13 and an external device such ECU, and the high pressure connector for the spark plug 12 are formed separately. However, the common connector 21 and the high pressure connector may be formed integrally to be used in common. Compared to the case that connectors are arranged separately with respect to each of the injector 11, the spark plug 12 and the pressure sensor 13, the structure for the electrical connecting can be simplified. In addition, the injector 11, the spark plug 12 and the pressure sensor 13 are arranged in the common housing 10 circumferentially. However, the injector 11, the spark plug 12 and the pressure sensor 13 may be arranged in the common housing 10 to be aligned in the lateral direction. In this case, it is preferable that the spark plug 12 is arranged at the center and the pressure sensor 13 is arranged at the inlet side in which the valve 5 is located.

In the present embodiment, the bottom surface of the common housing 10 and the tip end portions of the injector 11 and the pressure sensor 13 are formed to configure the same plane with the bottom surface of the cylinder head 3 smoothly without irregularities. However, the bottom surface of the common housing 10 and the tip end portions of the injector 11 and the pressure sensor 13 may be arranged to be slightly concave from the bottom surface of the cylinder head 3. Moreover, the fixing method of the injector 11, the spark plug 12 and the pressure sensor 13 with respect to the common housing 10 and the fixing method of the common housing 10 with respect to the cylinder head 3 are not limited to the welding or bolting. The other fixing method such as caulking or brazing may be used. In addition, the material and the shape of the gasket having heat resistance and the O-ring may be modified in various ways.

The engine head module of the present invention can be provided in a cylinder head of an engine of vehicles, vessels or the like.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. An engine head structure for an engine having a cylinder room, the engine head structure comprising:
- an engine head module that includes
  - a common housing, and
  - an injector, a spark plug, and a pressure sensor which are integrally assembled in the common housing;
- a coolant passage to which an engine coolant is supplied, the coolant passage being provided at an outer peripheral portion of the common housing; and
- a cylinder head having a mounting hole in which the common housing is fixed, wherein
- the pressure sensor is located to detect a pressure inside the cylinder room, and
- tip end portions of the injector, the spark plug and the pressure sensor integrated in the common housing are configured to face inside of the cylinder room.

2. The engine head structure according to claim 1, wherein the injector, the spark plug and the pressure sensor are configured to be tilted with respect to a line parallel to a center line of the common housing so that the injector, the spark plug and the pressure sensor are closer to a center of the cylinder room toward the cylinder room.

3. The engine head structure according to claim 1, further comprising a plurality of O-rings, wherein
- the common housing has a concave portion at an outer wall surface of the common housing, and the concave portion is configured to define a gap between the outer wall surface of the common housing and an inner wall of the mounting hole, and
- the plurality of O-rings are arranged at two sides of the gap so that the coolant passage is configured.

4. The engine head structure according to claim 1, wherein a bottom surface of the common housing and the tip end portions of the injector and the pressure sensor are positioned substantially on the same plane with a bottom surface of the cylinder head smoothly without irregularities.

5. An engine head structure for an engine having a cylinder room, the engine head structure comprising:
- an engine head module that includes
  - a common housing, and
  - an injector, a spark plug, and a pressure sensor which are integrally assembled in the common housing;
- a cylinder head having a mounting hole in which the common housing is fixed;
- a gasket having a heat resistance;
- a flange portion provided at a top end portion in the common housing; and
- a connecting portion arranged in the flange portion to cover the mounting hole from a top side, wherein
- the pressure sensor is located to detect a pressure inside the cylinder room,
- tip end portions of the injector, the spark plug and the pressure sensor integrated in the common housing are configured to face inside of the cylinder room,
- the gasket is arranged at an outer wall of a lower end portion of the common housing to seal a gap between the lower end portion of the outer wall of the common housing and an inner wall of the mounting hole, and
- the common housing is fixed to the cylinder head by bolting at the connecting portion.

6. An engine head structure for an engine having a cylinder room, the engine head structure comprising:
- an engine head module that includes
  - a common housing, and
  - an injector, a spark plug, and a pressure sensor which are integrally assembled in the common housing;
- a cylinder head having a mounting hole in which the common housing is fixed; and
- a common connector arranged on a top surface of the common housing, wherein
- the pressure sensor is located to detect a pressure inside the cylinder room,
- tip end portions of the injector, the spark plug and the pressure sensor integrated in the common housing are configured to face inside of the cylinder room, and
- the common connector electrically connects at least one of the injector, the spark plug, the pressure sensor to an external device.

* * * * *